US009347725B2

(12) United States Patent
McAlister

(10) Patent No.: US 9,347,725 B2
(45) Date of Patent: May 24, 2016

(54) SEMIAUTOMATIC RIFLE TRIGGER MECHANISM

(71) Applicant: Kenneth McAlister, Chandler, AZ (US)

(72) Inventor: Kenneth McAlister, Chandler, AZ (US)

( * ) Notice: Subject to any disclaimer, the term of this patent is extended or adjusted under 35 U.S.C. 154(b) by 120 days.

(21) Appl. No.: 14/283,260

(22) Filed: May 21, 2014

(65) Prior Publication Data

US 2015/0338181 A1 Nov. 26, 2015

(51) Int. Cl.

| | |
|---|---|
| ***F41A 9/61*** | (2006.01) |
| ***F41A 19/10*** | (2006.01) |
| ***F41A 19/14*** | (2006.01) |
| ***F41A 19/12*** | (2006.01) |
| ***F41A 19/08*** | (2006.01) |
| ***F41A 19/09*** | (2006.01) |

(52) U.S. Cl.

CPC ..... *F41A 19/10* (2013.01); *F41A 19/08* (2013.01); *F41A 19/09* (2013.01); *F41A 19/12* (2013.01); *F41A 19/14* (2013.01); *Y10T 29/49961* (2015.01)

(58) Field of Classification Search

CPC ..... F41A 19/10; F41A 19/14; F41A 19/12; F41A 19/08; F41A 19/09

USPC ..... 42/60, 69.01, 69.02, 69.03, 16

See application file for complete search history.

(56) References Cited

U.S. PATENT DOCUMENTS

| | | | | | |
|---|---|---|---|---|---|
| 1,184,078 | A * | 5/1916 | Cooke | F41G 1/40 | 42/118 |
| 1,290,855 | A * | 1/1919 | Wesson | F41A 3/64 | 42/69.02 |
| 1,307,594 | A * | 6/1919 | Newman | F41A 1/04 | 42/106 |
| 1,344,991 | A * | 6/1920 | Cunningham | F41A 3/26 | 42/16 |
| 1,386,247 | A * | 8/1921 | Fordyce | F41A 9/76 | 42/69.01 |
| 3,488,488 | A * | 1/1970 | Crouch | F41G 1/35 | 362/110 |
| 4,450,751 | A * | 5/1984 | Thevis | F41A 17/46 | 89/129.02 |
| 4,463,654 | A * | 8/1984 | Barnes | F41A 19/09 | 42/74 |
| 4,562,659 | A * | 1/1986 | Neta | F41A 3/26 | 42/71.01 |
| 4,677,781 | A * | 7/1987 | Lee | F41A 11/02 | 42/70.01 |
| 4,856,410 | A * | 8/1989 | Anderson | F41A 3/76 | 89/155 |

(Continued)

OTHER PUBLICATIONS

Bushmaster Bullpup Operation and Safety Instructions. Downloadable version. Jul. 1999, Bushmaster Firearms Inc. Quality Parts Co., Windham, Maine.

*Primary Examiner* — Michelle R Clement

(74) *Attorney, Agent, or Firm* — James L Farmer

(57) ABSTRACT

Methods and apparatus are provided for a semiautomatic rifle with a trigger in a receiver portion of the rifle positioned substantially forward of a back end of the rifle barrel, and a hammer assembly that includes a pivotally mounted sear, a disconnector, and a hammer mounted in the receiver behind the back end of the barrel. A hammer linkage proximate the hammer assembly has a first end connected to the trigger by a pull rod, and a second end configured to push a back end of the sear in an upward direction.

15 Claims, 7 Drawing Sheets

(56) References Cited

U.S. PATENT DOCUMENTS 4,869,008 A * 9/1989 Rasmussen ..... F41A 19/09 42/69.01
4,932,148 A * 6/1990 Barrett ..... F41A 19/10 42/18
5,770,814 A * 6/1998 Ealovega ..... F41A 19/04 89/131
6,526,683 B1 * 3/2003 Crandall ..... F41A 19/09 42/40
6,722,072 B1 * 4/2004 McCormick ..... F41A 19/10 42/69.03
6,772,548 B1 8/2004 Power
7,047,684 B2 * 5/2006 Roh ..... F41C 23/00 42/16
7,165,352 B2 * 1/2007 Langlotz ..... F41A 19/16 42/69.03
7,356,958 B2 * 4/2008 Weir ..... F41A 19/00 42/42.02
7,421,937 B1 9/2008 Gangl
8,615,915 B2 * 12/2013 Hunter ..... F41A 19/10 42/69.01
8,782,940 B1 * 7/2014 Morris ..... F41A 11/02 42/69.01
8,931,393 B1 * 1/2015 Vincent ..... F41A 17/46 42/70.06
9,015,981 B2 * 4/2015 Zamlinsky ..... F41C 23/20 42/75.01
9,021,935 B1 * 5/2015 Kellgren ..... F41A 15/12 89/193
9,062,922 B1 * 6/2015 Burt ..... F41A 9/74
9,109,856 B1 * 8/2015 Zamlinsky ..... F41C 23/20
9,115,954 B1 * 8/2015 Corsi ..... F41C 7/02
9,200,857 B1 * 12/2015 Kellgren ..... F41A 15/12
2006/0048426 A1 * 3/2006 Crandall ..... F41A 19/18 42/69.01
2006/0101693 A1 * 5/2006 Langlotz ..... F41A 19/16 42/69.01
2011/0167696 A1 * 7/2011 Gangl ..... F41A 17/46 42/69.03
2011/0209607 A1 * 9/2011 St. George ..... F41A 3/26 89/191.01
2011/0283582 A1 * 11/2011 Hunter ..... F41A 19/10 42/69.02
2011/0315002 A1 * 12/2011 Keough ..... F41A 19/46 89/128
2012/0144712 A1 * 6/2012 Rostocil ..... F41A 9/79 42/16
2013/0185975 A1 * 7/2013 Johnson ..... F41A 19/09 42/69.02
2014/0075803 A1 * 3/2014 Muller ..... F41A 11/02 42/16
2014/0075812 A1 * 3/2014 Johnson ..... F41A 19/08 42/69.01
2014/0373418 A1 * 12/2014 Hu ..... F41A 19/46 42/69.03
2015/0107143 A1 * 4/2015 Coetzee ..... F41G 11/003 42/14
2015/0219421 A1 * 8/2015 Zamlinsky ..... F41C 23/20 42/71.01
2015/0241156 A1 * 8/2015 Alicea, Jr. ..... F41A 17/06 89/28.1
2015/0267977 A1 * 9/2015 Boyarkin ..... F41A 19/09 89/191.01
2015/0300763 A1 * 10/2015 Huther ..... F41A 17/74 89/148
2016/0018176 A1 * 1/2016 Fellows ..... F41A 19/06 42/69.03

* cited by examiner

FIG. 1A
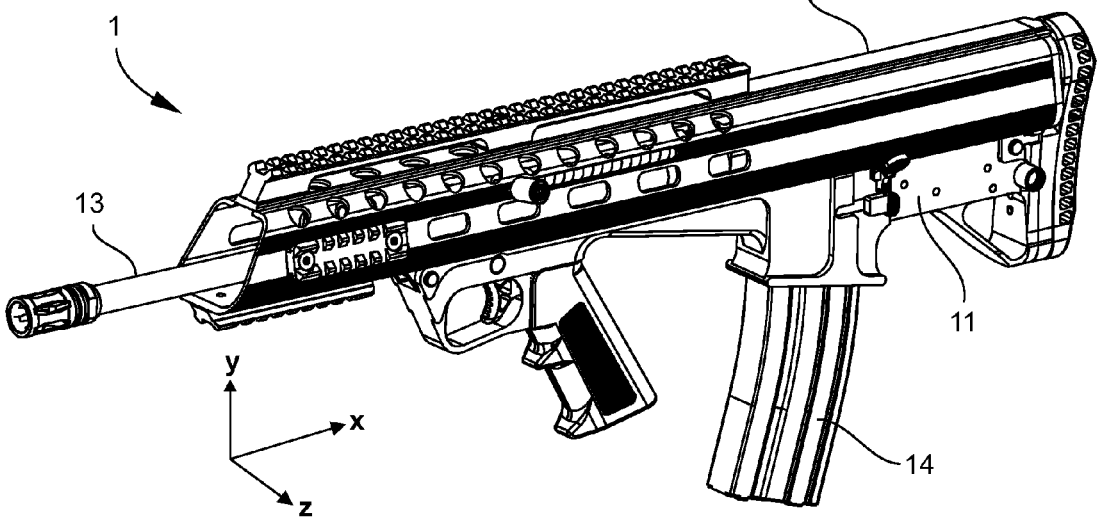
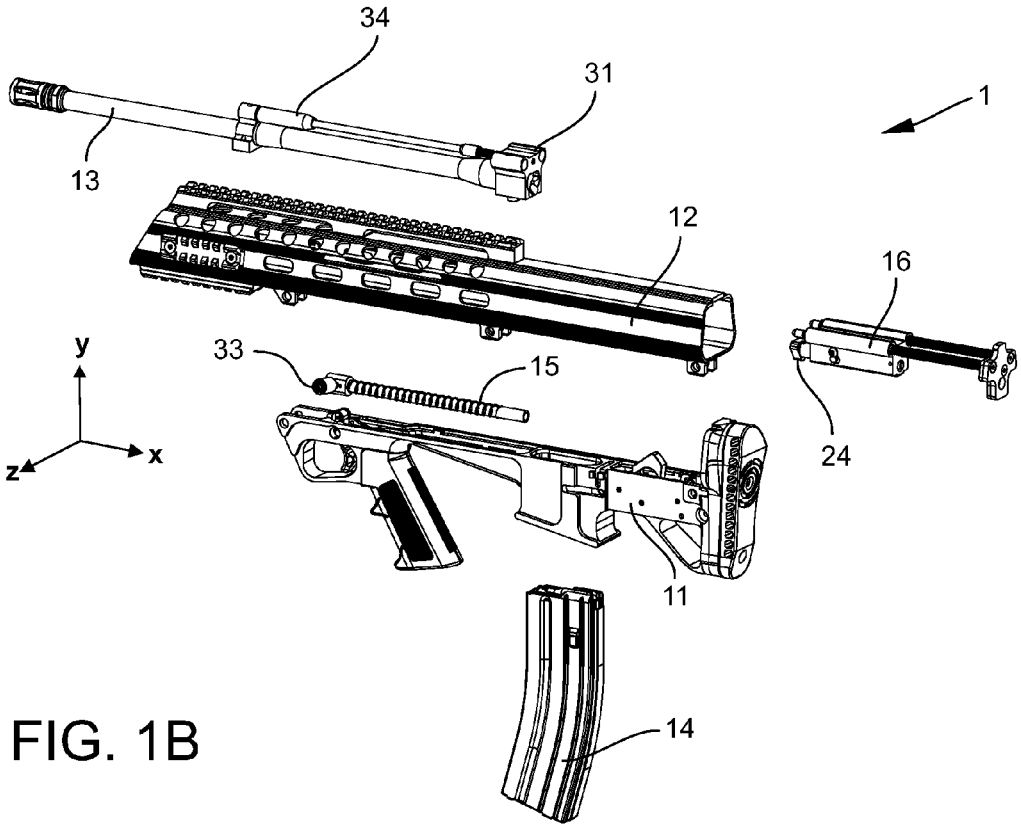
FIG. 1B

SEMIAUTOMATIC RIFLE TRIGGER MECHANISM

TECHNICAL FIELD

The technical field of the present invention generally relates firing actions of semi-automatic and automatic firearms, including for example, firing and triggering mechanisms associated with bullpup style semi-automatic rifles, a configuration in which the trigger is located in front of the magazine, and the hammer mechanism is located behind the magazine.

BRIEF DESCRIPTION OF THE DRAWINGS

In the accompanying drawings:

FIGS. 1A and 1B depict a semiautomatic bullpup style rifle in accordance with the present disclosure;

DESCRIPTION OF THE EMBODIMENTS

Figure 2:
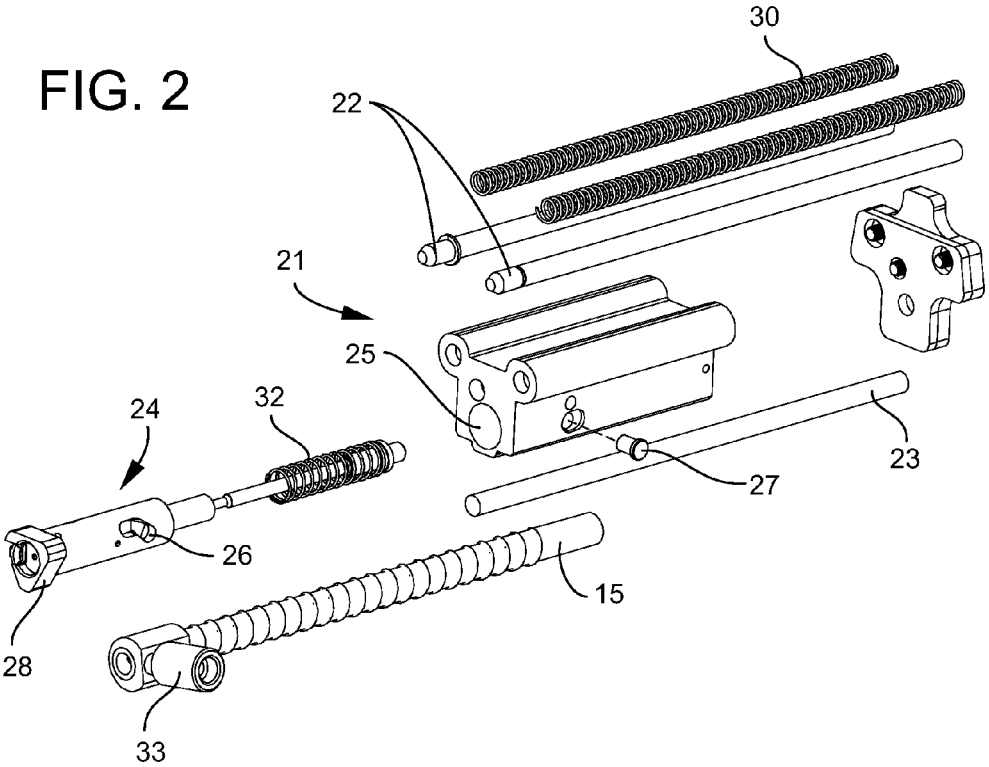
FIG. 2 is an exploded view of a bolt carrier group portion of the semiautomatic rifle of FIG. 1.
Figure 2:
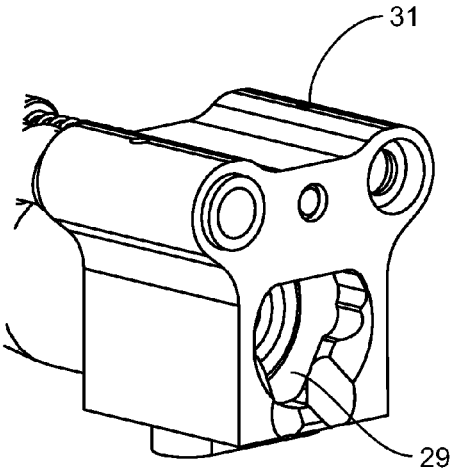

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Referring now to the drawing figures, an exemplary bullpup style semi-automatic rifle is depicted, and indicated generally at reference numeral 1. The rifle 1 comprises a lower receiver assembly 11, an upper receiver assembly 12, a barrel assembly 13, a magazine 14, a charger assembly 15, and a bolt carrier group 16. For convenience in this disclosure, the following conventions will be used when referring to directions and orientations of the firearm unless otherwise noted in context. Referring to the coordinate triad shown in FIG. 1, the +Y direction will be "up", or toward the top of the rifle, −Y direction will be "down", the −X direction will be "forward", or toward the end of the barrel, the +X direction will be "rearward", or toward the rifle butt, the +Z direction will be to the left looking from the back of the rifle, and the −Z direction will be to the right. In addition, terms such as "vertical", "above", "below", "higher", "lower", "top", "bottom" and the like, correspond to the Y direction unless otherwise noted; terms such as "longitudinal", "front", "back", "in front of", and "behind" correspond to the X direction unless otherwise noted; and terms such as "lateral", "side", or "sideways" correspond to the Z axis unless noted otherwise. Thus for example, the butt of the rifle is behind the barrel, and the magazine is below the barrel.

Figure 3:
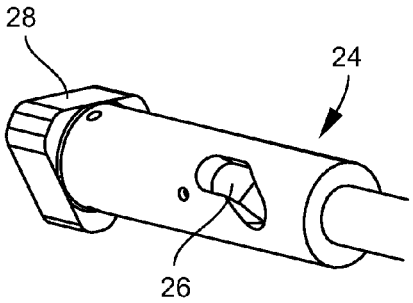
FIG. 3 is a close up perspective view of the bolt, cam track, and the open end of the barrel extension.
Figure 4:
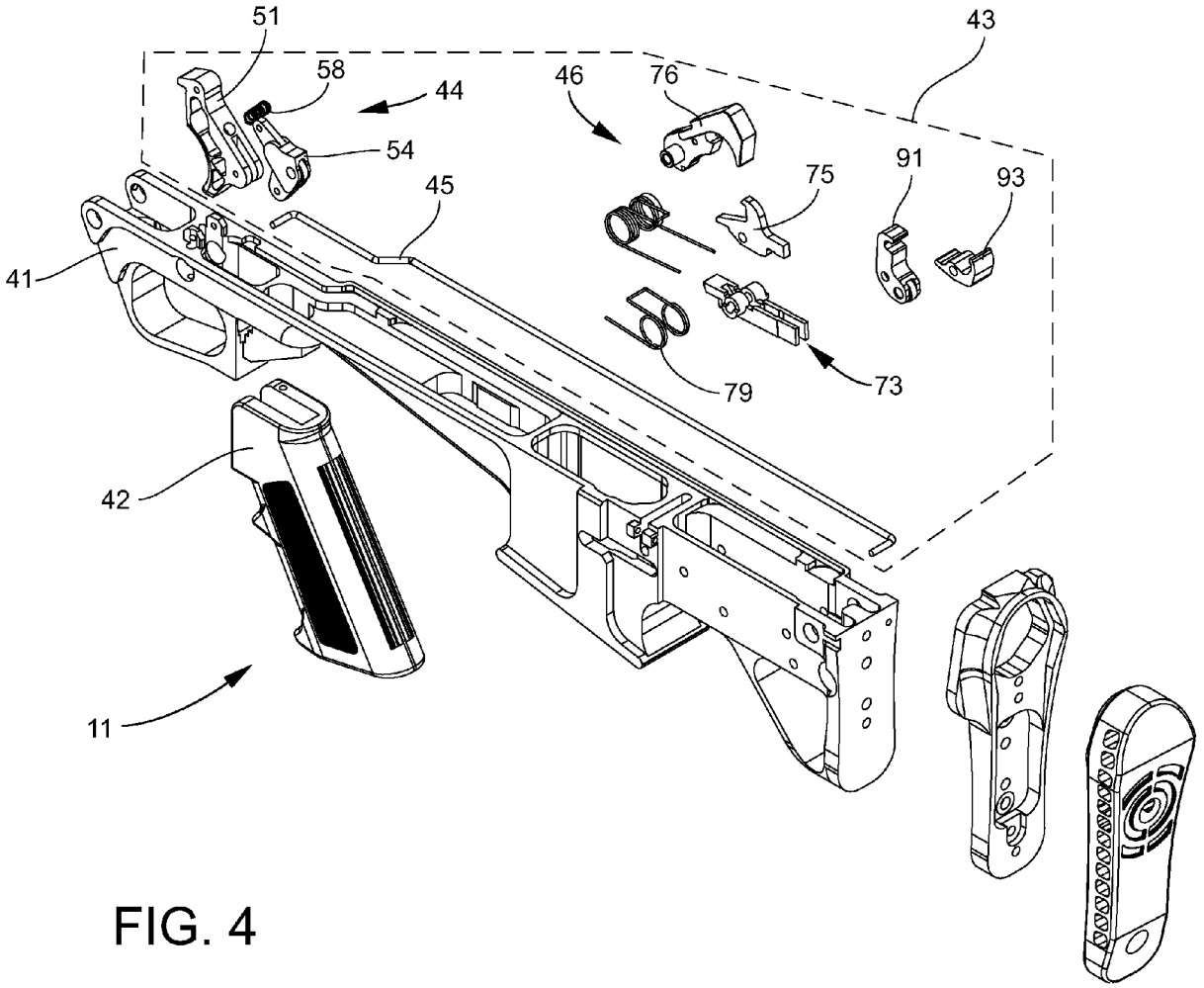
FIG. 4 is an exploded view of the lower receiver assembly portion of the semiautomatic rifle of FIG. 1.
Figure 5:
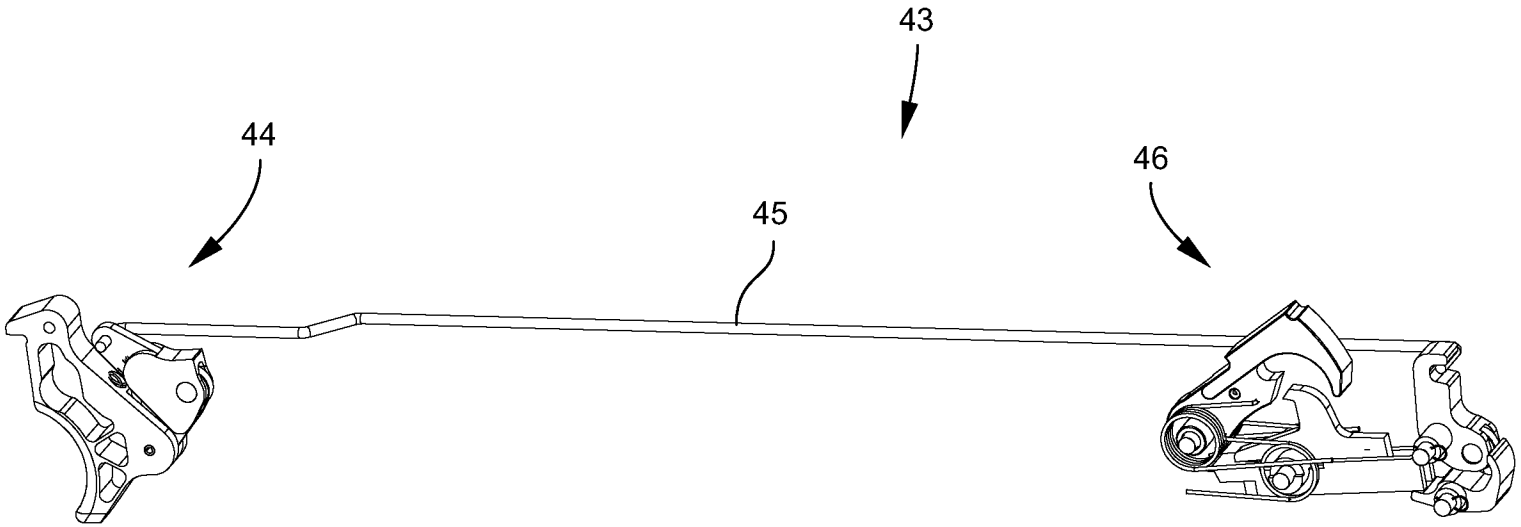
FIG. 5 is a perspective view of an exemplary trigger assembly in accordance with the present disclosure.

Referring now to FIGS. 2 and 3, a bolt carrier group 16 comprises a body 21 slidably supported on guide rods 22 and a cam rod 23. A spring loaded bolt 24 is slidably disposed in a longitudinal bore 25 extending through body 21. A spiral cam track 26 formed in the side of bolt 24 receives a cam pin 27 that projects into the bore 25 from the side of body 21. The forward end of bolt 24 comprises a three-lobed locking head 28 configured to pass through a matching three-sided opening 29 in a rear wall of barrel extension 31. When the bolt is caused to plunge in and out of bore 25, the cam track 26 slides along cam pin 27 causing the bolt to rotate between an unlocked position where the locking head 28 can pass through opening 29, and a locked position in which the lobes of locking head 28 interfere with opening 29.

A bolt spring 32 normally urges the bolt 24 out of bore 25 toward the extended, unlocked position. When the body 21 is displaced back from the barrel extension 31, either by manual operation of the charging handle 33 or when driven back by charging piston 34 (FIG. 1B), the bolt spring 32 will extend the bolt to the unlocked position. Thus when the body and bolt are moving forward toward the barrel, such as after a round has been fired and ejected, the locking head 28 is properly oriented to pass through opening 29 of barrel extension 31. Locking occurs when the locking head clears opening 29 and bottoms out against the back end of the barrel, while momentum and the guide rod springs 30 continue to move the body 21 forward. The relative motion between the body 21 and bolt 24 rotates the bolt in a first direction via cam track 26 and pin 27 until the lobes of locking head 28 are out of alignment with opening 29, locking the bolt against the barrel. The body 21 is held forward against the barrel extension 31 by the guide rod springs 30, maintaining the bolt in the locked position until another round fires.

To unlock the bolt, the sequence is reversed. For example, when another round is fired, the body 21 is driven back by the charging piston, rotating the bolt with the cam pin and cam track in a second, opposite direction. When the bolt is again fully extended and the bolt head is rotated to the unlocked position, the body 21 withdraws the bolt head from opening 29 as it continues to move back for chambering another round.

Figure 6:
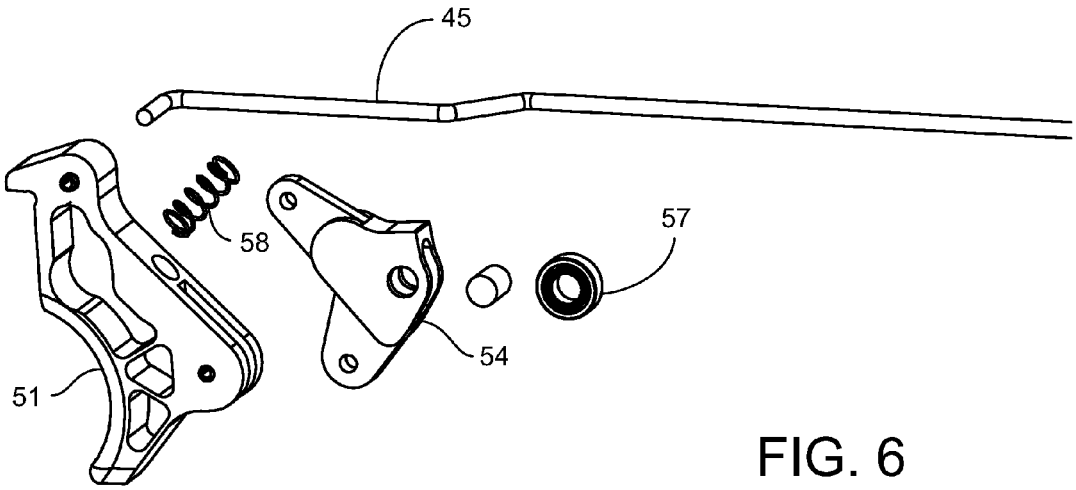
FIGS. 6 and 7 depict the forward action portion of the trigger assembly shown in FIG. 5.
Figure 7:
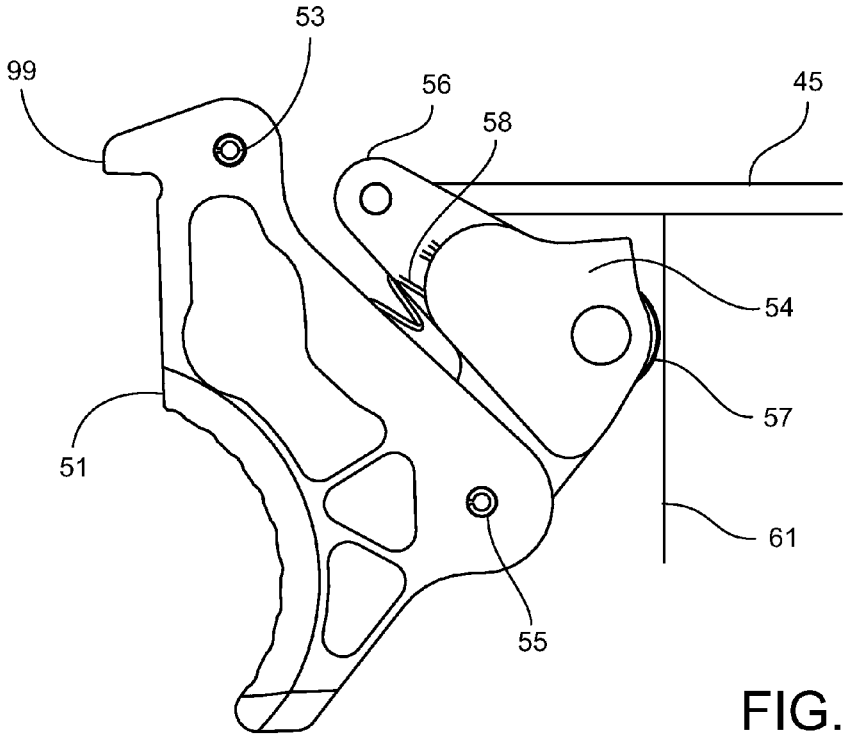

Referring now to FIGS. 4 through 9, the lower receiver assembly comprises generally a lower receiver housing 41, a pistol grip 42, and a trigger assembly 43 that includes a forward action 44 connected by a pull rod 45 to a rear action 46. Referring particularly to FIGS. 6 and 7, the forward action comprises a trigger 51 and a trigger cam 54. The trigger 51 is pivotally connected to the receiver housing at trigger pivot 53. A lower end of a trigger cam 54 is pivotally connected to a back corner of the trigger at trigger cam pivot 55, and an upper end 56 of the trigger cam is connected to the pull rod 45. A trigger cam bearing 57 is mounted in a back corner of the trigger cam, and configured to bear against and roll along a vertical wall 61 in the lower receiver housing 41. In one embodiment the trigger cam bearing is a sealed ball bearing, with the outer race directly contacting the vertical wall. A cam return spring 58 disposed between the back of the trigger 51 and the front of the trigger cam 54 urges the trigger cam away from the trigger, and ensures that the bearing 57 bears against the housing wall 61 at all times.

Figure 8:
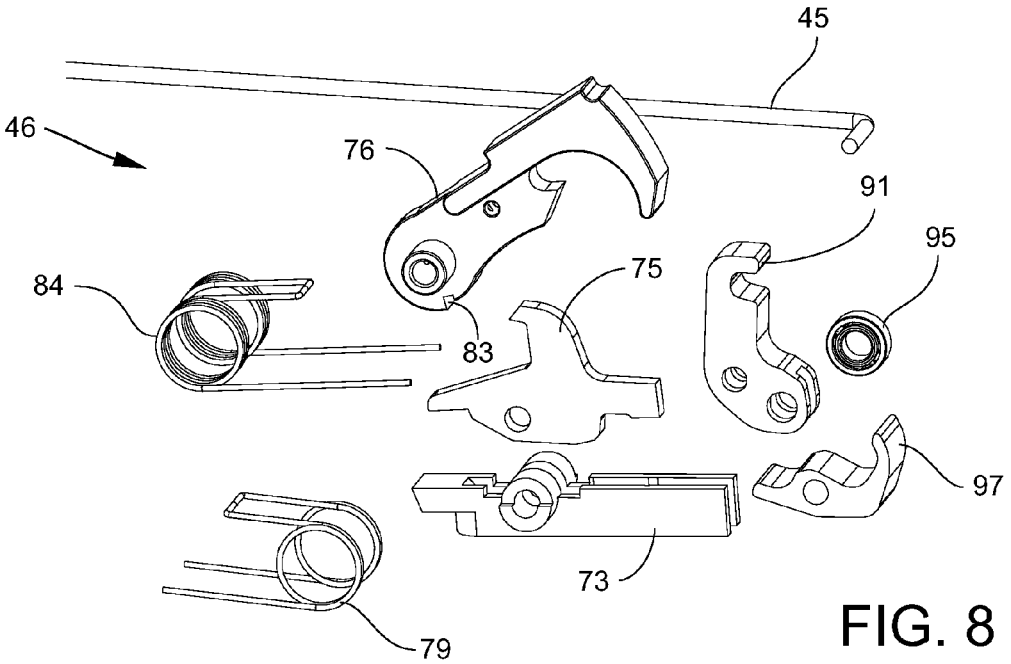
FIGS. 8 and 9 depict the rear action portion of the trigger assembly shown in FIG. 5.
Figure 9:
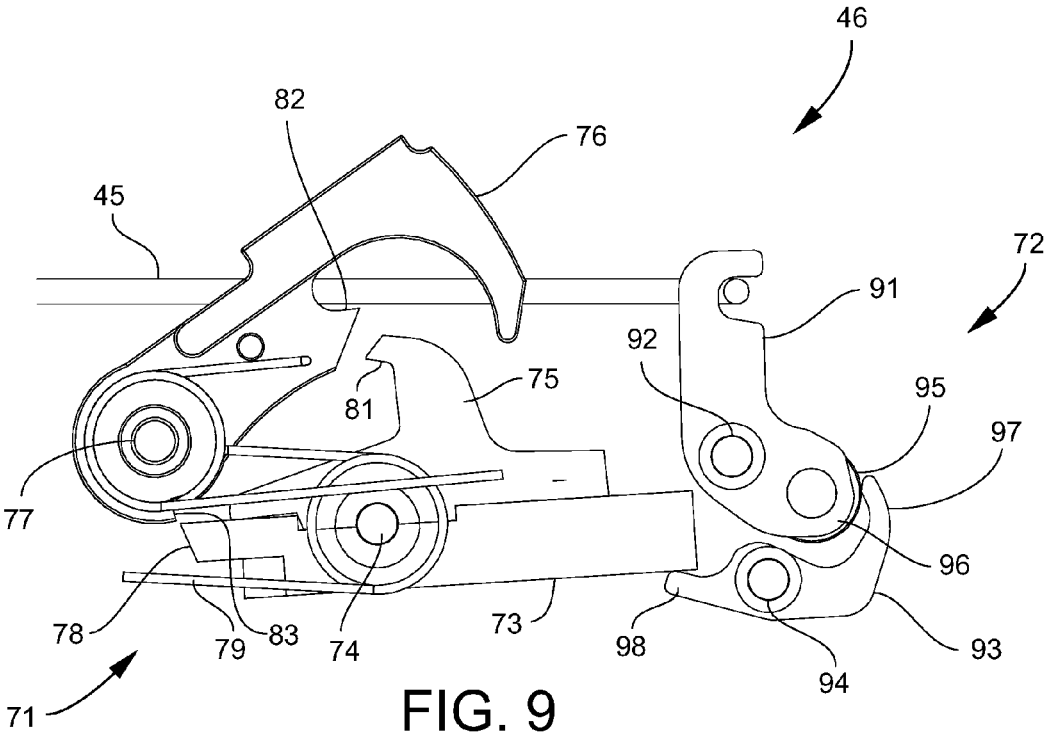

Referring to FIGS. 8 and 9, the rear action 46 consists generally of a hammer assembly 71 connected to the pull rod 45 by a hammer linkage 72. The hammer assembly 71 comprises a sear 73 and disconnector 75 pivotally connected to the receiver housing 41 at sear pivot 74, a hammer 76 pivotally mounted at a hammer pivot 77, and a hammer spring 84 capable imparting the acceleration needed when the hammer strikes the firing pin. The disconnector 75 operates in a conventional manner, using a spring loaded action, and a catch 81 that catches a hook 82 on hammer 76 after a round has been fired and before the trigger is released. The sear 73 is an elongated member with a hammer catch surface 78 at a forward end thereof to catch a notch 83 in the hammer when the trigger is released, and a central cavity to receive the disconnector 75. A sear return spring 79 applies a clockwise rotational bias to the sear and disconnector (in the direction of raising the front and lowering the back of the sear). The sear return spring is used to rotate the sear to lock the hammer when the trigger is released, and to ensure that catch surface 78 stays in hammer notch 83 at all times when the action is cocked. In one particular embodiment the hammer assembly 71 comprises stock parts for the well known AR-15 semi-automatic assault rifle, including the AR-15 hammer, hammer spring, disconnector, disconnector spring, trigger, and trigger spring. In this particular embodiment however the AR-15 trigger is made to serve as the sear 73 by simply removing the finger lever. The other AR-15 parts may be used essentially as-is.

The hammer linkage 72 is configured to oppose the rotational force applied by sear spring 79 and raise the back end of the sear when the trigger is depressed and rod 45 is pulled forward. The hammer linkage may comprise a single member such as a simple lever or bell crank, or a multi-piece construction. In the depicted embodiment the hammer linkage 72 is a two-piece assembly, comprising a hammer cam 91 mounted to the housing 41 at hammer cam pivot 92, and a hammer cam lever 93 mounted to the housing at cam lever pivot 94. A hammer cam roller bearing 95 is mounted in a lower, rearward extending lobe 96 of hammer cam 91, and configured to bear against a rear arm 97 of cam lever 93. The rear arm 97 may curve upward to partially wrap around roller bearing 95 as shown. The cam roller bearing rolls to accommodate relative tangential motion between the lobe 96 and rear arm 97 that would otherwise result in sliding and friction. A forward arm 98 of cam lever 93 bears against a bottom surface of the back end of the sear 73.

Figure 10:
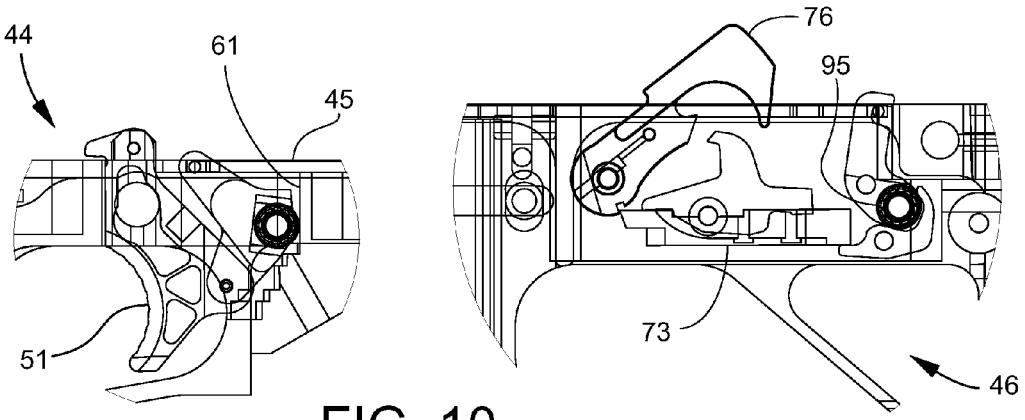
FIGS. 10 through 12 show the trigger assembly progressing from the cocked and ready position in FIG. 10 to the firing position in FIG. 12.
Figure 11:
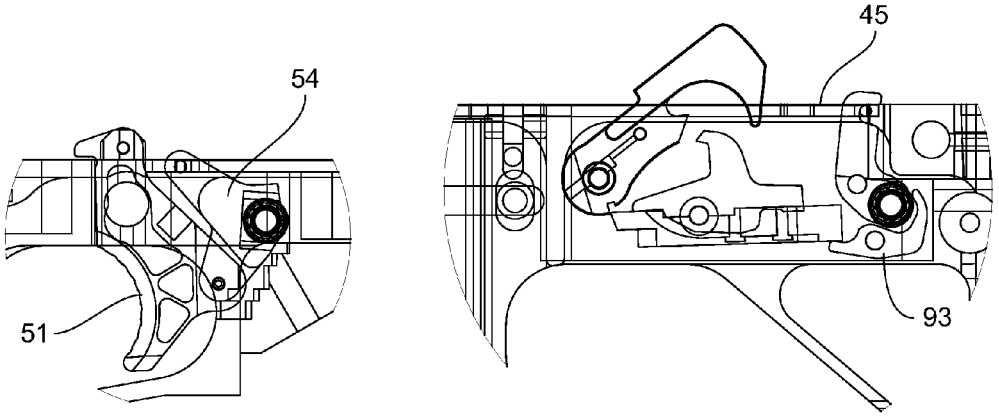
Figure 12:
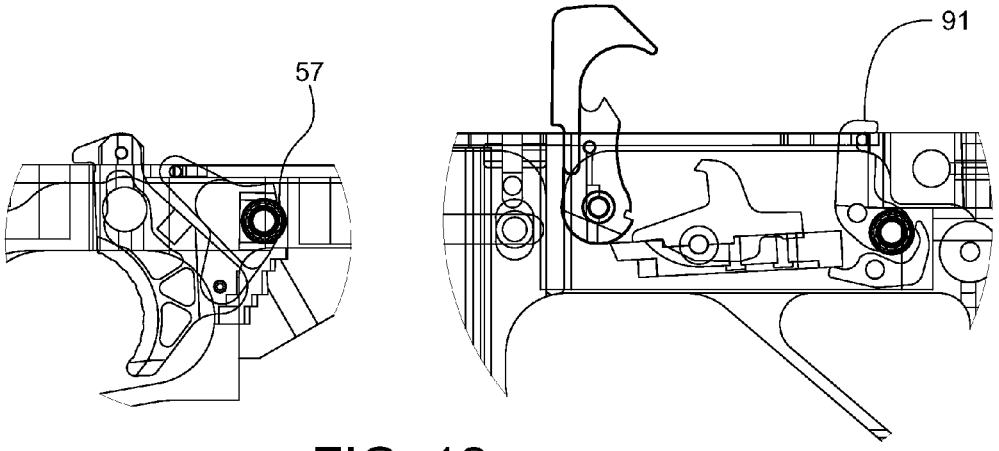

Operation of the trigger assembly is illustrated in FIGS. 10 through 12. It should be noted that many of the earlier defined reference numerals that are mentioned again in this portion of the description have been omitted from FIGS. 10 through 12 for the sake of clarity. FIG. 10 shows the assembly cocked and ready to fire, such as after a round has been fired, or from manually chambering a round using the charging handle. In this position the trigger 51 is completely released (forward), and pull rod 45 is at its most rearward position. Looking at the rear action 46, the front arm 98 of cam lever 93 is at its lowest position, and the back end of the sear is bearing down against arm 98 under the rotational influence of the sear spring 79. At the front of sear 73, the catch surface 78 is fully engaged in hammer notch 83, restraining the hammer in the cocked position. Unless the trigger is manually depressed, the sear 73 and hammer linkage 72 will tend to hold the pull rod at its most rearward position, and the forward action 44 in the released position shown.

FIG. 11 shows the assembly with the trigger pulled partially back, and prior to the hammer being released. At the forward action 44, the trigger has pivoted back somewhat relative to its position in FIG. 10, causing the trigger cam 56 to pivot up about the trigger cam pivot 55. As the trigger cam pivots, the trigger cam bearing 57 rolls up wall 61, while the upper end 56 of the trigger cam moves longitudinally forward, bringing with it the pull rod 45. The trigger cam bearing 57 is forced to stay in contact with wall 61 due to the combined forces exerted on cam 54 by the cam return spring 58 and pull rod 45.

Looking at the rear action 46, the hammer cam 91 has pivoted counterclockwise (when viewed from the left side of the rifle as shown) as a result of pull rod 45 being pulled forward by the trigger cam. The counterclockwise rotation of cam 91 swings lobe 96 back, and causes the hammer cam bearing 95 to push arm 97 of cam lever 93 rearward, producing a clockwise rotation of lever 93. Due to the curved shape of back arm 97 and relative size of cam bearing 95, the contact between the bearing and arm is essentially at a single point on the distal end of the arm as shown. The clockwise rotation of cam lever 93 causes the front arm 98 to swing up, pushing the back end of the sear up, and the front end down. Although in this position the front end of the sear has moved down, part of the catch surface 78 is still in notch 83, and the hammer is still in the cocked position.

FIG. 12 shows the assembly when the trigger is pulled all the way back to the firing position, and the hammer has been released. At the forward action, a flange 99 (see FIG. 7) at the upper end of the trigger bottoms out on the top of the receiver housing 41, acting as a stop to limit the maximum trigger pull. The flange 99 is configured to bottom out before the front of the trigger cam 54 makes contact with the back of the trigger. The trigger cam bearing 57 is now at its highest position along wall 61, while the upper end 56 of cam 54 has horizontally translated the pull rod to its forward most position.

At the rear action, the pull rod 45 has pulled the upper end of hammer cam 91 further forward, causing hammer cam bearing 95 to further deflect rear arm 97 of cam lever 96. The resulting additional clockwise rotation causes the front lever arm 98 to drive the back end of sear 73 further up, rotating the sear counter clockwise enough for catch surface 78 to completely disengage hammer notch 83. The hammer spring 84 swings the hammer counterclockwise until the face of the hammer strikes the firing pin 35. With the exception of the hammer 76, the rear action will remain in the position shown as long as the trigger is not released. When the hammer hitting the firing pin causes a round to fire, the bolt carrier body 21 will slide back before the trigger can be released, pushing the hammer back down until the hammer hook 82 snaps under the disconnector catch 81. Releasing the trigger will then allow the sear spring 79 to rotate the sear clockwise until the catch 81 releases hook 82, allowing the hammer to rotate counterclockwise slightly until the catch surface 78 of sear 73 again engages hammer notch 83.

EXAMPLE

In one exemplary embodiment of the invention, the pull rod 45 moves forward by approximately 1/16 inch when the trigger is pulled all the way from the released position of FIG. 10 to the firing position of FIG. 12. The pull rod 45 displaces a first end of a hammer linkage 72, causing a second end of the hammer linkage to lift the back end of the sear 73 by approximately 3/32 inches. Lifting the back end of the sear causes the sear to rotate by approximately 3 degrees, and the front end of the sear to move downward by approximately 1/32 inch.

In another exemplary embodiment, the hammer linkage 72 comprises the two piece mechanism shown in the drawings, and the above recited forward movement of the pull rod when the trigger is pulled produces a counterclockwise rotation of the hammer cam 91 of approximately 10 degrees. The hammer cam rotation in turn causes the cam lever 97 to rotate clockwise by approximately 15 degrees; and the cam lever rotation causes the sear 73 to rotate counterclockwise by approximately 3.5 degrees.

In another exemplary embodiment, the hammer assembly comprises stock AR-15 rifle parts modified in the manner described above. In all embodiments the trigger pull is substantially smooth and consistent, and without any noticeable catching or binding. The trigger pull force required to release the hammer is less than approximately 6 lbs., and in one embodiment the pull force is approximately 3.5 lbs. Despite the relatively low trigger pull force, the above disclosed trigger assembly provides sufficient spring force to prevent the cocked hammer from being inadvertently released due to impact or vibration, such as when the rifle is accidentally dropped on the ground.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. A semiautomatic rifle comprising:

a trigger mounted in a receiver portion of the rifle, and positioned substantially forward of an ammunition magazine;

a hammer assembly in the receiver behind the ammunition magazine, the hammer assembly comprising a pivotally mounted sear, a disconnector, and a hammer, wherein the sear has a forward end and a back end, the forward end defining a hammer catch configured to engage a locking feature on the hammer when the front end of the sear is in a raised position, and disengage the locking feature when the front end of the sear is in a lowered position; and a hammer linkage proximate the hammer assembly, the hammer linkage having a first end connected to the trigger by an elongated rod, and a second end proximate the back end of the sear, wherein the first end of the hammer linkage comprises a pivotally mounted hammer cam with an upper end connected to the elongated rod, and the second end of the hammer linkage comprises a pivotally mounted cam lever with a rear arm adjacent a rearward extending lobe of the hammer cam, and a forward arm that extends under the back end of the sear, and wherein pulling the trigger back causes the second end of the hammer linkage to lift the back of the sear, thereby rotating the sear about its pivot and lowering the front end of the sear.

2. The semiautomatic rifle of claim 1, wherein pulling the trigger back pulls the elongated rod and upper end of the hammer cam forward, causing the rearward extending lobe of the trigger cam to displace the rear arm of the cam lever in a rearward direction, in turn causing the front arm of the cam lever to displace the back end of the sear upward.

3. The semiautomatic rifle of claim 1, further comprising a roller bearing mounted in the rearward extending lobe of the trigger cam, the roller bearing configured to bear against the rear arm of the cam lever.

4. The semiautomatic rifle of claim 2, wherein the trigger comprises a trigger lever pivotally mounted in the receiver, and a trigger cam pivotally mounted to a back side of the trigger, and wherein the elongated rod is connected to an upper end of the trigger cam.

5. The semiautomatic rifle of claim 4, further comprising a roller bearing in a back side of the trigger cam configured to bear against and roll along a vertical wall in the receiver when the trigger is displaced.

6. The semiautomatic rifle of claim 1, wherein the trigger pull force is less than about six pounds.

7. A semiautomatic rifle comprising:

a trigger assembly positioned substantially forward of an ammunition magazine, the trigger assembly comprising a trigger lever pivotally mounted to a receiver portion of the rifle, and a trigger cam pivotally mounted to a back side of the trigger lever;

a hammer assembly in the receiver behind the ammunition magazine, the hammer assembly comprising a pivotally mounted sear, a disconnector, and a hammer; and a hammer linkage proximate the hammer assembly, the hammer linkage having a pivotally mounted hammer cam connected to the trigger cam by an elongated rod at a back end thereof, and a pivotally mounted hammer cam lever proximate the back end of the sear and movable by the hammer cam, wherein pulling back the trigger lever displaces the elongated rod and the hammer cam, causing the hammer cam lever to displace a back end of the sear in a generally upward direction, in turn causing a front end of the sear to displace in a generally downward direction, and a hammer catch surface at the front end of the sear to disengage from a locking feature on the hammer.

8. The semiautomatic rifle of claim 7, wherein an upper end of the hammer cam is connected to the elongated rod, and wherein the hammer cam lever has a rear arm disposed adjacent a rearward extending lobe of the hammer cam, and a forward arm that extends under the back end of the sear.

9. The semiautomatic rifle of claim 8, wherein a roller bearing mounted in the rearward extending lobe of the hammer cam is configured to bear against the rear arm of the cam lever, and roll to accommodate relative tangential motion between the hammer cam lobe and the cam lever rear arm.

10. The semiautomatic rifle of claim 7, wherein force required to pull back the trigger lever is less than six pounds.

11. A semiautomatic rifle comprising:

a trigger in a receiver portion of the rifle substantially forward of a back end of the rifle barrel;

a hammer assembly in the receiver behind the back end of the barrel, the hammer assembly comprising a pivotally mounted sear, a disconnector, and a hammer; and a hammer linkage proximate the hammer assembly, the hammer linkage having a pivotally mounted hammer cam connected to the trigger by a pull rod at a back end thereof, and a pivotally mounted hammer cam lever configured to be movable by the hammer cam and to push a back end of the sear in an upward direction.

12. The semiautomatic rifle of claim 11, wherein the trigger pull force does not exceed six pounds.

13. The semiautomatic rifle of claim 11, wherein an upper end of the hammer cam is connected to the pull rod, and wherein the hammer cam lever has a rear arm disposed adjacent a rearward extending lobe of the hammer cam, and a forward arm that extends under the back end of the sear.

14. The semiautomatic rifle of claim 13, wherein a roller bearing mounted in the rearward extending lobe of the hammer cam is configured to bear against the rear arm of the cam lever, and roll to accommodate relative tangential motion between the hammer cam lobe and the cam lever rear arm.

15. The semiautomatic rifle of claim 11, wherein the trigger comprises a trigger lever pivotally mounted in the receiver, and a trigger cam pivotally mounted to a back side of the trigger, and wherein the pull rod is connected to an upper end of the trigger cam.

* * * * *